US010658756B1

(12) United States Patent
Marrero-Fontanez et al.

(10) Patent No.: US 10,658,756 B1
(45) Date of Patent: May 19, 2020

(54) EARTH COVERAGE ANTENNA SYSTEM FOR KA-BAND COMMUNICATION

(71) Applicant: United States of America as represented by the Administrator of NASA, Washington, DC (US)

(72) Inventors: Victor J. Marrero-Fontanez, Greenbelt, MD (US); Cornelis F. Du Toit, Ellicott City, MD (US)

(73) Assignee: United States of America as represented by the Administrator of NASA, Washington, DC (US)

( * ) Notice: Subject to any disclaimer, the term of this patent is extended or adjusted under 35 U.S.C. 154(b) by 204 days.

(21) Appl. No.: 15/857,021

(22) Filed: Dec. 28, 2017

(51) Int. Cl.
*H01Q 15/14* (2006.01)
*H01Q 3/26* (2006.01)
*H01Q 1/28* (2006.01)

(52) U.S. Cl.
CPC ..... *H01Q 15/147* (2013.01); *H01Q 1/288* (2013.01); *H01Q 3/2664* (2013.01)

(58) Field of Classification Search
CPC ..... H01Q 15/147; H01Q 1/28; H01Q 3/26
USPC ..... 343/761
See application file for complete search history.

(56) References Cited

U.S. PATENT DOCUMENTS

2009/0109108 A1* 4/2009 Oliver ..... H01Q 1/42 343/761
2009/0224993 A1* 9/2009 Peichl ..... G01S 13/426 343/761

* cited by examiner

*Primary Examiner* — Andrea Lindgren Baltzell
(74) *Attorney, Agent, or Firm* — Christopher O. Edwards; Bryan A. Geurts

(57) ABSTRACT

An earth coverage antenna system includes a reflector, a feed horn and a strut. The reflector has a circularly symmetric reflector surface. The feed horn is positioned on the symmetry axis of the reflector and is attached to the strut. The feed horn transmits RF microwave energy toward the reflector surface. The antenna system further includes two cables that prevent side-ways movement of the strut. The antenna system further includes a lens assembly that directs microwave energy away from the central region of the reflector. The antenna system further includes a microwave energy scattering device disposed at the center of the reflector to scatter microwave energy away from the feed horn. The reflector surface is defined by a perturbed parabolic geometrical shape that is swept around the symmetry axis. The reflector reflects most microwave energy towards the earth's horizon, but diverts enough microwave energy towards the regions closer to nadir so as to maintain an isoflux of energy on the earth's surface. The reflector shape is optimized to minimize flux ripples caused by interference of the microwave energy scattered from the microwave energy scattering device.

18 Claims, 10 Drawing Sheets

EARTH COVERAGE ANTENNA SYSTEM FOR KA-BAND COMMUNICATION

ORIGIN OF INVENTION

The invention described herein was made by an employee of the United States Government, and may be manufactured and used by or for the Government for governmental purposes without the payment of any royalties thereon or therefor.

CROSS REFERENCE TO OTHER PATENT APPLICATIONS

None.

FIELD OF THE INVENTION

The present invention relates to an Earth coverage antenna.

BACKGROUND

Earth coverage antennas are typically used for X-band to Ka-band communications purposes on Earth observing mission spacecraft in low Earth orbits. Such spacecrafts are required to provide ultra-stable platforms for scientific instruments. The antenna is mounted on the side of the spacecraft facing the Earth, pointing towards nadir, but with a wide shaped-beam to cover most or all of the visible part of the Earth. The wide-beam of an Earth coverage antenna maintains an almost isoflux of energy on the Earth. The advantage of an isoflux antenna is that it does not require any moving parts and hence will not cause any vibrations that may affect sensitive scientific instruments on the spacecraft. The Earth coverage antenna has been used for X-band communications in several Earth observation missions including NASA missions such as TERRA, AQUA, LandSat, NPP and JPSS-1. These missions have used two types of Earth Coverage antennas, namely quadrifilar antennas which have peak gain values around 4 dBi and reflectors, which have peak gain values around 8 dBi. Quadrifilar antennas at Ka-band are unfeasible due to manufacturing tolerances. Therefore the reflector antenna option is preferable. Reflector Earth coverage antennas have the advantage of higher gain, but also have the disadvantage of aperture blockage due to strut supports and the feed horn itself. Aperture blockage causes partial "shadows" in certain directions and is mostly unavoidable since the feed horn needs mechanical support to keep it in position relative to the reflector. Although the feed horn aperture blockage cannot be avoided, some conventional antenna systems have eliminated the use of struts by using either a central pole or a radome. One typical radome is described in US Patent Publication No. US20120242539, entitled "Antenna System For Low Earth Orbit Satellites". However, these alternate designs compromise the antenna performance in different ways. For example, the radome or central pole causes losses and reflections that affect the feed horn performance. Aperture blockage also causes diffraction ripples in the radiation patterns, especially near the shadow regions. The reflector shape necessarily brings its central part close to the feed horn, which is near the feed horn's boresight direction. The level of radiation is the strongest in the feed horn's boresight direction. A significant portion of the radiation is reflected directly back towards the feed horn wherein it is scattered in all directions. A portion of this reflected radiation travels back into the feed horn where it typically is diverted into a resistive load termination. This causes not only energy loss, but the scattering of the radiation off of the feed horn also causes additional interference ripples in the antenna radiation pattern. Since the signal flux on the earth's surface must be kept above a certain level to avoid loss of signal link with ground stations, the presence of interference ripples in the antenna radiation pattern requires that the weaker radiation portions of the antenna pattern be increased to overcome the dips in the pattern. This in turns lowers the peak gain of the antenna, thereby compromising signal strength towards the horizon.

SUMMARY OF THE INVENTION

The Earth coverage antenna system of the present invention includes a microwave feed horn and a reflector. In the transmit mode, the feed horn illuminates the reflector with RF microwave energy. The reflector, in turn, reflects the RF microwave energy down to the earth's surface. The reflector is curved in such a way that the illumination intensity on the earth's surface is constant. The reflector cross-section has a perturbed parabolic shape such that most of the RF microwave energy transmitted by the feed horn is diverted towards the areas near the Earth's horizon, since those areas are farthest away and suffer the most signal attenuation. Specifically, the reflector cross-section has a shape that is parabolic, except for near the center of the reflector where it is geometrically perturbed in order to divert a small portion of the RF microwave energy towards nadir and the closely surrounding areas. The reflector cross-section curve is swept or rotated around the nadir axis to produce the full 3-dimensional surface. The antenna radiation pattern is "bowl-shaped". The rim of the "bowl" is the strong radiation direction wherein such radiation is directed towards the horizon, which is typically about ~65° from nadir depending on the orbital height. The hollow part of the "bowl" is the weak radiation direction, wherein such radiation is directed towards nadir and surrounding nearby regions.

A feature of the antenna system of the present invention is a lens that is used to reduce microwave radiation directed towards the part of the reflector that is closest to the feed horn, thereby minimizing losses due to back-reflection and scattering.

Another feature of the antenna system of the present invention is that the central part of the reflector employs a shaped protrusion, referred to herein as a "microwave energy scattering device". The microwave energy scattering device scatters most of the reflected microwave radiation that is reflected back to the feed horn. As a result, most of this reflected microwave radiation is scattered away from the feed horn, thereby reducing back-reflection towards the feed horn and minimizing losses due to diversion into a termination load.

Another feature of the antenna system of the present invention is that the reflector is shaped so as to compensate for interference ripples in the antenna radiation pattern caused by the scattering of microwave radiation off of the feed horn.

Another feature of the antenna system of the present invention is the use of a single strut and a pair of anchoring cables to hold the strut in place. This configuration minimizes strut aperture blockage.

In one aspect, the present invention is directed to an earth coverage antenna system includes a reflector, a feed horn and a strut. The reflector has a circularly symmetric reflector surface. The feed horn is positioned on the symmetry axis of the reflector and is attached to the strut. The feed horn transmits RF microwave energy toward the reflector surface. The antenna system further includes two cables that prevent side-ways movement of the strut. The antenna system further includes a lens assembly that directs microwave energy away from the central region of the reflector. The antenna system further includes a microwave energy scattering device disposed at the center of the reflector to scatter microwave energy away from the feed horn. The reflector surface is defined by a perturbed parabolic geometrical shape that is swept around the symmetry axis. The reflector reflects most microwave energy towards the earth's horizon, but diverts enough microwave energy towards the regions closer to nadir so as to maintain an isoflux of energy on the earth's surface. The reflector shape is optimized to minimize flux ripples caused by interference of the microwave energy scattered from the microwave energy scattering device.

In another aspect, the present invention is directed to an antenna system comprising a reflector having a shaped reflector surface that has a central region, and a microwave energy scattering device attached to the reflector and located in the central region such that the microwave energy scattering device is centrally located on the reflector surface. The microwave energy scattering device is shaped to scatter impinging microwave energy emanating from a microwave energy source so as to reduce the amount of microwave energy that is reflected back to the microwave energy source. The reflector surface includes a generally flat peripheral region immediately surrounding the central region. The reflector further includes a perimetrical edge. The reflector surface slopes between the peripheral region and the perimetrical edge.

Other aspects and advantages of the invention will become apparent from the following detailed description taken in conjunction with the accompanying drawings which illustrate, by way of example, the principles of the described embodiments.

DESCRIPTION OF EXEMPLARY EMBODIMENTS OF THE INVENTION

As used herein, the term "spacecraft" refers to any type of spacecraft used in space or space applications and includes satellites, CubeSats, space stations, capsules, rockets, probes, pods, planetary rovers and other space exploration vehicles.

Figure 1A:
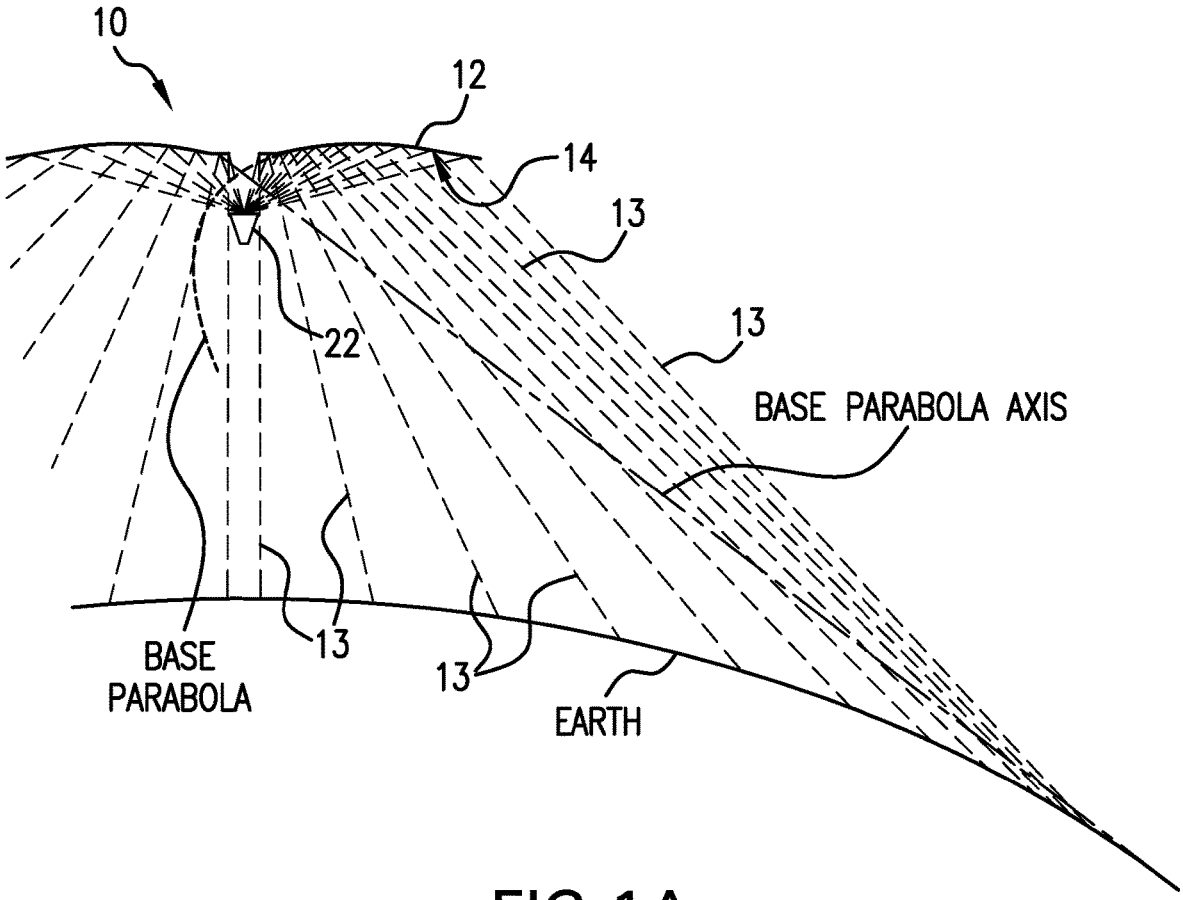
FIG. 1A is a cross-section diagram illustrating the antenna radiation pattern of an antenna system in accordance with one embodiment of the present invention.
Figure 2:
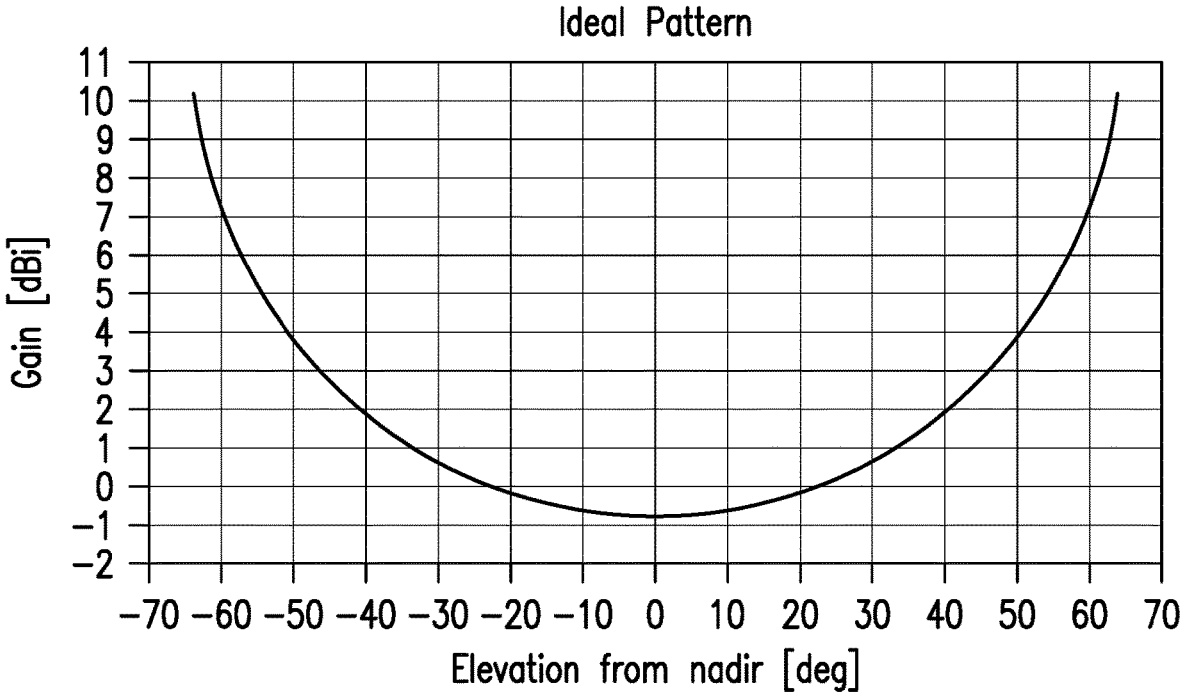
FIG. 2 illustrates ideal antenna radiation wherein gain is a function of the angle from nadir.

FIG. 1A is a diagram that illustrates the antenna radiation pattern produced by antenna system 10 of the present invention. In the transmit mode, the feed horn 22 directs microwave energy (i.e. radiation) to reflector 12. Reflector 12 has a reflector surface 14 that is illuminated by the radiation emanating from the feed horn 22. As used herein, the term "transmit mode" refers to an operational mode of antenna system 10 wherein feed horn 22 is the transmitting source. The "receive mode" performance is by reciprocity, the same as the transmit mode performance. In transmit mode, the feed horn 22 illuminates the reflector surface 14 with radiation. In response, reflector surface 14 reflects radiation 13 down to the earth's surface. Reflector surface 14 is curved in such a way that the illumination intensity on the earth's surface is constant. Most of the radiation transmitted by feed horn 22 is diverted towards the areas near the earth's horizon since those areas are farthest away and suffer the most signal attenuation. In order to facilitate understanding of the paths of the reflected radiation 13, FIG. 1A shows reference lines representing the base parabolic axis and the base parabola curvature of the reflector cross-section. The geometric cross-sectional shape of reflector 12 is generally that of a tilted, base parabolic curve except for the portion near the center of reflector surface 14 where the geometry of reflector surface 14 is perturbed in order to divert a small portion of the radiation 13 towards nadir and the close, surrounding areas. The cross-section of reflector 12 is swept or rotated around the nadir axis to create the full 3-dimensional shape. Therefore, the antenna radiation pattern is "bowl-shaped" with the rim of the "bowl" (i.e. the strong radiation directions) directed towards the horizon, which is typically about ~65° from nadir depending on the orbital height, and the hollow part of the "bowl" (i.e. weak radiation direction) directed towards nadir and surrounding nearby regions. This antenna radiation pattern substantially matches the ideal antenna radiation pattern shown in FIG. 2.

Figure 1B:
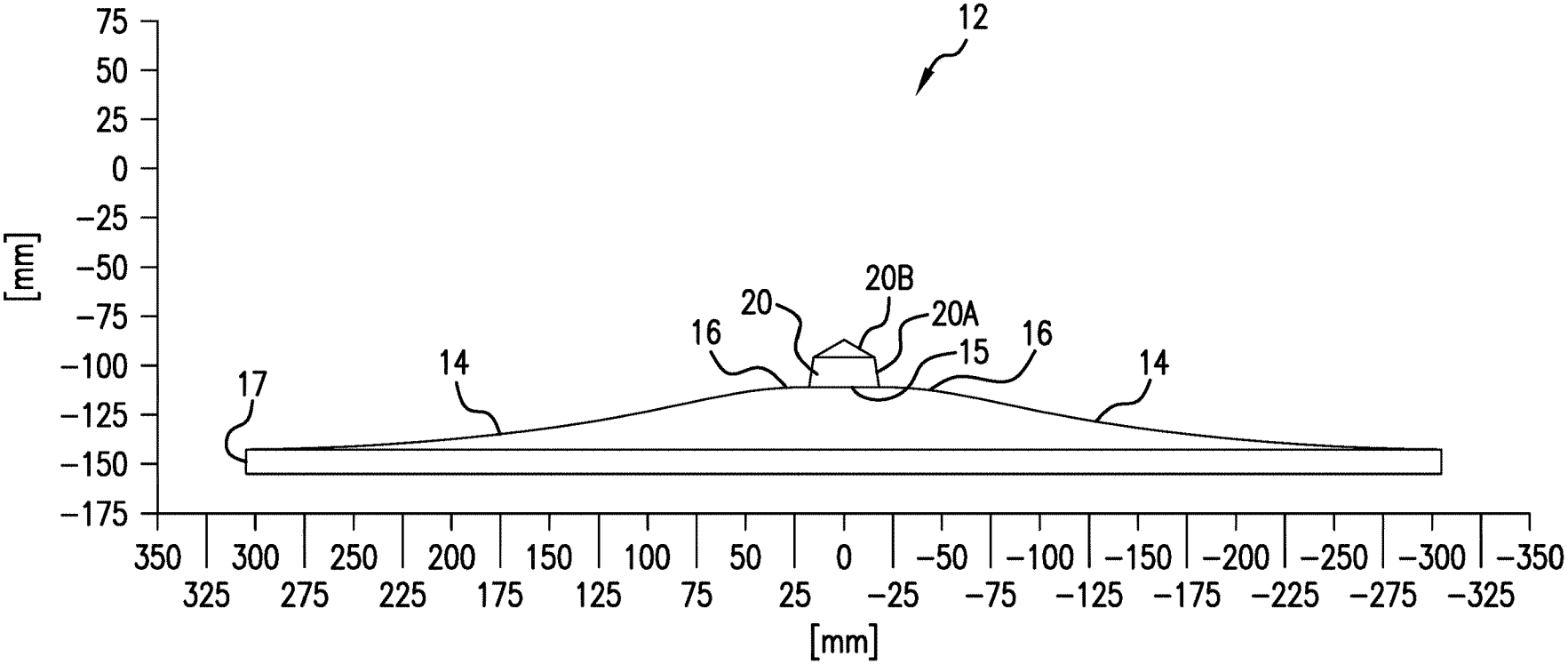
FIG. 1B is a side view of a reflector of the antenna system.

Referring to FIG. 1B, there is shown a side view of reflector 12 which is part of antenna system 10. Reflector 12 has shaped reflector surface 14 that has central region 15. Reflector surface 14 includes generally flat peripheral region 16 immediately surrounding central region 15. Reflector 12 further includes perimetrical edge 17. Reflector surface 14 slopes between peripheral region 16 and perimetrical edge 17. Peripheral region 16 of reflector surface 14 is geometrically constrained to reflect power down to nadir and is blended gradually with the base parabola body-of-revolution shape to reflect radiation at ever larger angles away from nadir towards the earth's surface. Reflector 12 includes shaped microwave energy scattering device 20 attached to reflector surface 14 and located in central region 15 such that microwave energy scattering device 20 is centrally located on reflector surface 14. Microwave energy scattering device 20 has sidewall 20A and generally conical-shaped portion 20B. In an exemplary embodiment, both reflector 12 and microwave energy scattering device 20 are made from aluminum. However, other suitable metals having good electrical conducting properties may be used as well, e.g. gold, silver, copper and brass. Microwave energy scattering device 20 is shaped to scatter impinging microwave energy emanating from feed horn 22 so as to reduce the amount of microwave energy that is reflected back to feed horn 22. Thus, microwave energy scattering device 20 scatters most of the radiation reflected by reflector 12 that would normally be directed back to feed horn 22. As a result, most of this reflected RF microwave radiation is scattered away from feed horn 22 thereby reducing back-reflection towards feed horn 22 and minimizing losses due to diversion into termination load 80 (see FIGS. 3 and 4). Any suitable techniques or methods may be used to form shaped microwave energy scattering device 20 and attach or join shaped microwave energy scattering device 20 to central region 15 of reflector surface 14.

In other embodiments, reflector 12 and shaped microwave scattering device 20 are fabricated from thermally stable, electrical conducting composite materials. Suitable electrically conductive materials include thin film, nano-enabled conductive composites, conductive carbon fiber-reinforced plastic or any mechanically sturdy material covered by a conductive layer.

For a 26.5 GHz application requiring about 10 dBi peak gain, the diameter of reflector 12 is typically about 0.6 m in diameter, depending on the feed horn's radiation angular spread and the desired maximum gain.

Figure 3:
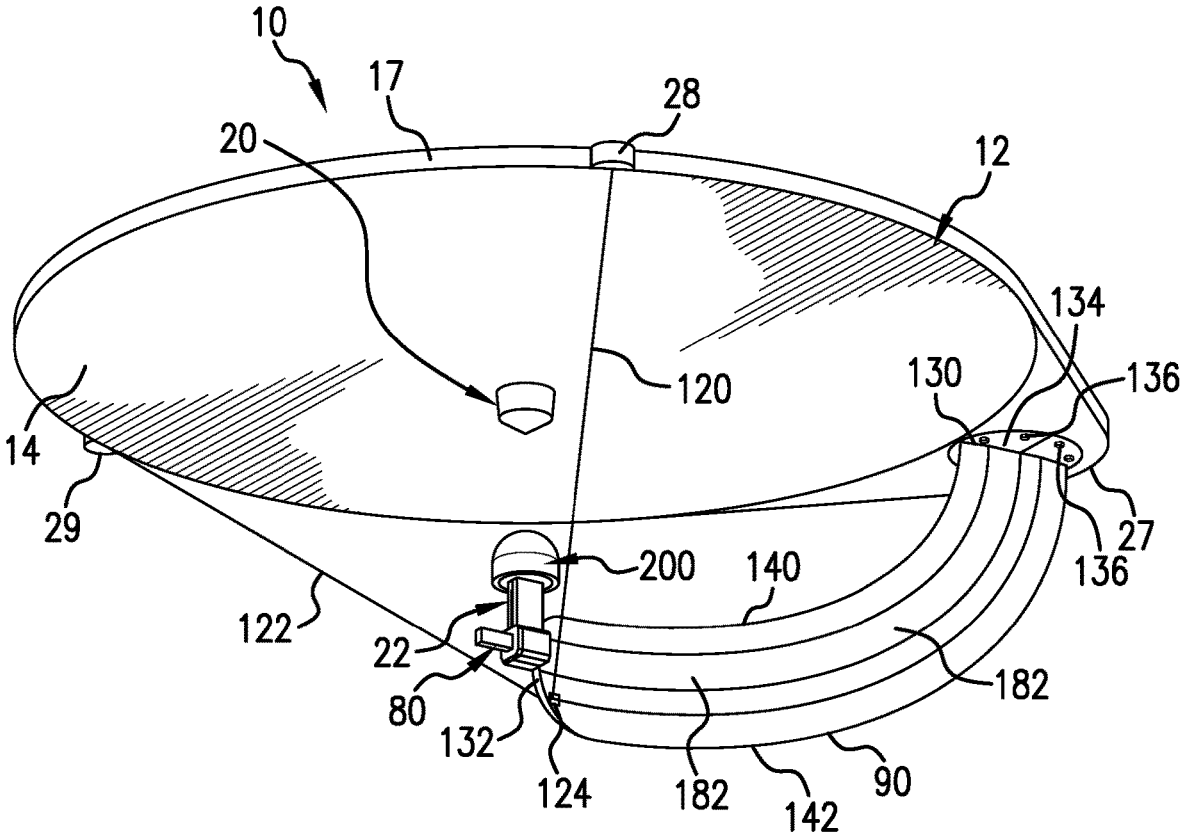
FIG. 3 is a perspective view of the antenna system that produces the antenna radiation pattern shown in FIG. 1A.
Figure 4:
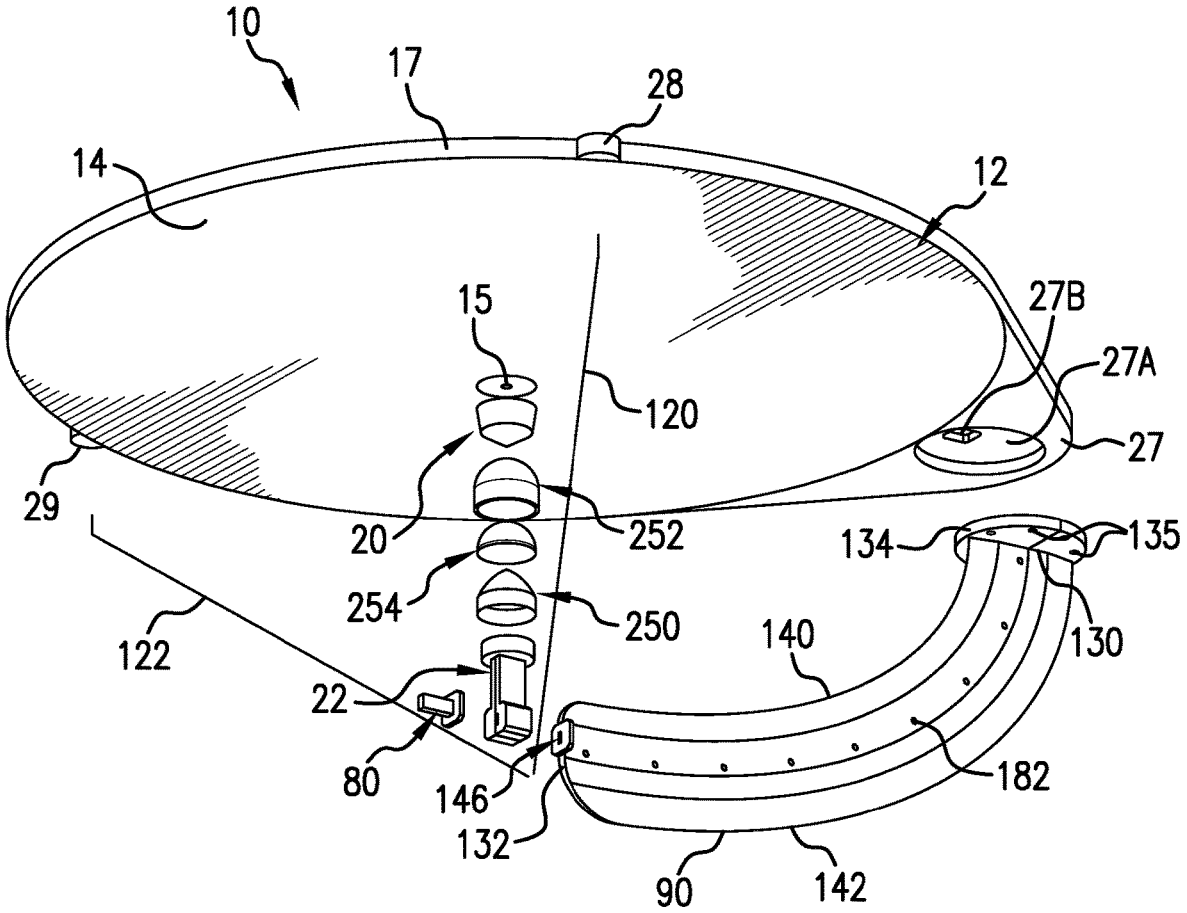
FIG. 4 is an exploded view of the antenna system shown in FIG. 3.

Referring to FIGS. 3 and 4, reflector 12 includes extending portions 27, 28 and 29 that extend from the circumference of reflector 12. Extending portion 27 includes recess 27A and thru-hole 27B located within recess 27A. The purpose of recess 27A and thru-hole 27B is described in detail in the ensuing description. Antenna system 10 further includes a single metal strut 90 that is attached or joined to extending portion 27. Strut 90 is briefly described here and then described in detail in the ensuing description. Strut 90 has an internal waveguide that receives microwave energy from a microwave source, such as a transmitter on board a spacecraft, and delivers this microwave energy to feed horn 22. Feed horn 22 then directs this microwave energy to reflector surface 14. Feed horn 22 may be fabricated from any of the metals previously discussed herein. Feed horn 22 includes polarizer fin 50 (see FIGS. 5A and 5B) and is discussed in detail in the ensuing description. Strut 90 positions the feed horn 22 at a predetermined position in relation to reflector surface 14. Feed horn 22 is connected to strut 90 so the microwave energy traveling through the internal waveguide in strut 90 is fed into polarizer waveguide port 72 (see FIGS. 5A and 5B) of feed horn 22. Load termination device 80 is connected to polarizer waveguide port 70. Load termination device 80 is well known in the art and therefore, is not discussed in detail herein. Feed horn 22 is capped by lens assembly 200. Lens assembly 200 is discussed in detail in the ensuing description.

Figure 5A:
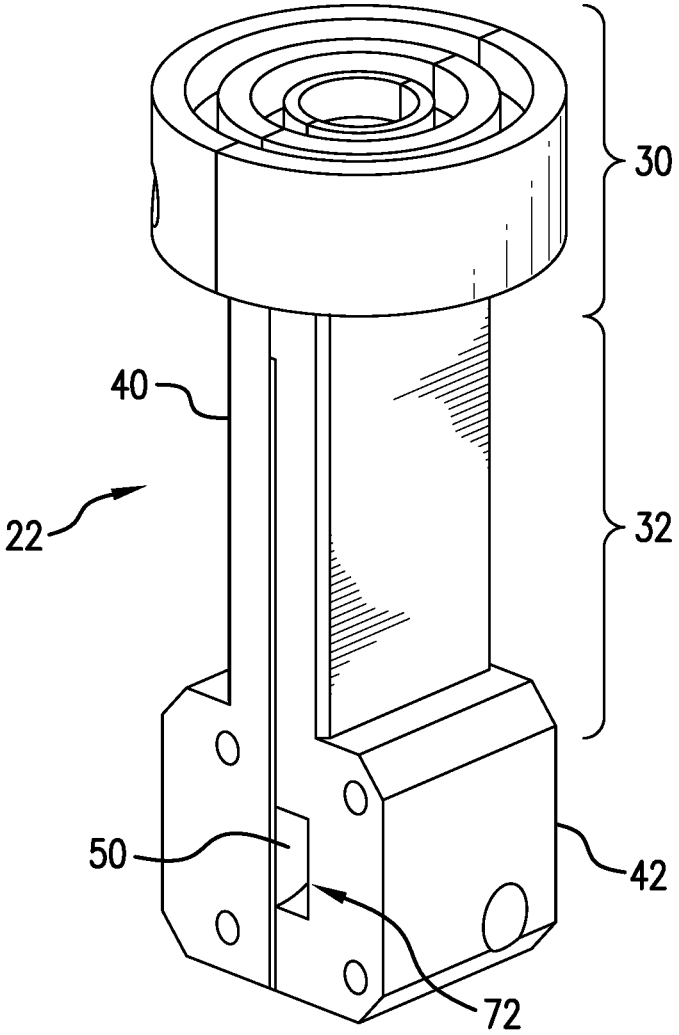
FIG. 5A is a perspective view of a microwave feed horn shown in FIG. 3.
Figure 5B:
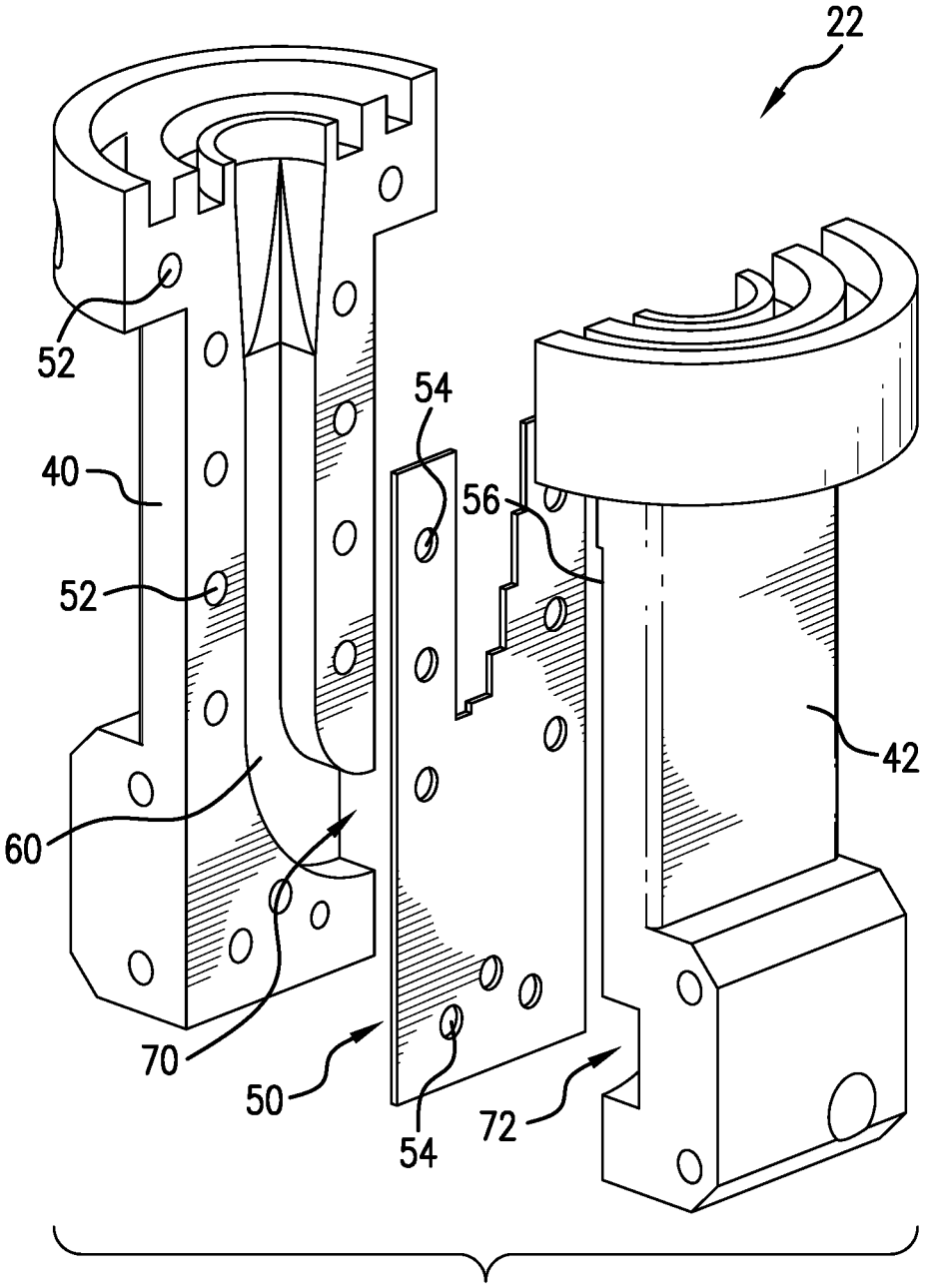
FIG. 5B is an exploded, perspective view, of the microwave feed horn.

Referring to FIGS. 5A and 5B, there is shown feed horn 22 in detail. Feed horn 22 has horn section 30 and polarizer section 32. Feed horn 22 comprises two half sections 40 and 42 that are removably attached together. In an exemplary embodiment, sections 40 and 42 are made from metal. Any of the suitable metals discussed previously herein may be used to fabricate sections 40 and 42. Feed horn 22 includes polarizer fin 50 that is sandwiched between sections 40 and 42. Section 40 has screw holes 52 that receive corresponding screws (not shown). In an exemplary embodiment, section 42 includes threaded screw inlets (not shown) that are configured to engage the screws that are inserted through screw holes 52 of section 40. Polarizer fin 50 includes holes 54 that are aligned with the screw holes 52 in section 40 and the threaded screw inlets (not shown) in section 42. This configuration allows sections 40 and 42 to be connected together with polarizer fin 50 sandwiched therebetween. Section 42 includes stepped recess 56 that is shaped to receive polarizer fin 50. Section 40 includes channel 60 formed therein which is one half of the internal waveguide that is formed when sections 40 and 42 are attached together. Similarly, section 42 includes a corresponding channel (not shown) formed therein which is the second half of the internal waveguide that is formed when sections 40 and 42 are attached together. Connecting sections 40 and 42 and polarizer fin 50 together forms waveguide ports 70 and 72. Waveguide ports 70 and 72 are isolated with only insignificant amounts energy coupling from one waveguide port to the other. Waveguide port 70 produces right-hand circular polarization (RHCP) and waveguide port 72 produces left-hand circular polarization (LHCP). As shown in FIG. 3, feed horn 22 is connected to strut 90 so that the microwave energy travelling through the internal waveguide of strut 90 enters waveguide port 72 and travels through the internal waveguide of feed horn 22 that is formed when sections 40 and 42 are attached together. Load termination device 80 is connected to waveguide port 70. Load termination device 80 is well known in the art and therefore, is not discussed in detail herein. For a 26.5 GHz application, feed horn 22 was about 60 mm tall with a useful radiation angular spread of about 65° from boresight, wherein the radiation level is about 13 dB below peak.

Referring to FIGS. 3, 4, 6A and 6B, strut 90 is configured so that its profile is as thin as possible in order to minimize blockage of microwave energy radiated or received by reflector 12. Strut 90 has a relatively large, vertical dimension in cross-section thereby presenting high mechanical resistance to vertical forces. Cables 120 and 122 are used to anchor strut 90 in order to suppress sideways movement of strut 90. In one embodiment, cables 120 and 122 are removably attached to reflector 12 and strut 90. One end of cable 120 is removably attached extending portion 28 of reflector 12 using any suitable techniques or devices. In one embodiment, the end of cable 120 is removably attached to extending portion 28 with a bolt (not shown) that is threaded and engaged into a corresponding threaded inlet (not shown) formed in reflector 12. In another embodiment, the end of cable 120 is attached to a cable tension adjuster device (not shown) which is removably attached to extending portion 28. The other end of cable 120 is removably attached to a corresponding side of strut 90. In one embodiment, strut 90 includes a pair of clamps, one of which being indicated by reference number 124 in FIG. 3, and the other clamp not being visible. The end of cable 120 is removably attached to clamp 124. In one embodiment, claim 124 is bolted to strut 90 and is removable. In another embodiment, clamp device 124 is integral with strut 90. In a further embodiment, clamp 124 is fixed to strut 90 and is not removable. Cable 122 is removably attached to extending portion 29 of reflector 12 and strut 90 by the same techniques and devices used to removably attach cable 120 to extending portion 28 and strut 90. However, it is to be understood that any suitable fastening or attachment means may be used to attach cable 120 and 122 to reflector 12 and strut 90.

As shown in FIGS. 3, 4, 6A and 6B, strut 90 includes end 130 and opposite distal end 132. In one embodiment, end 130 is removably attached or joined to extending portion 27 of reflector 12 by any suitable technique or method. End 130 includes flange portion 134 that is sized to fit into recess 27A of extending portion 27. In an exemplary embodiment, flange portion 134 has thru-holes 135 that receive threaded bolts 136 (see FIG. 3) which are used to attach flange portion 134 to extending portion 27. In such an embodiment, extending portion 27 includes threaded inlets (not shown) for receiving threaded bolts 136. Strut 90 includes sections 140 and 142 which, when attached or joined together, form internal waveguide channel 144. Internal waveguide channel 144 extends from end 130 to opposite distal end 132.

Figure 6B:
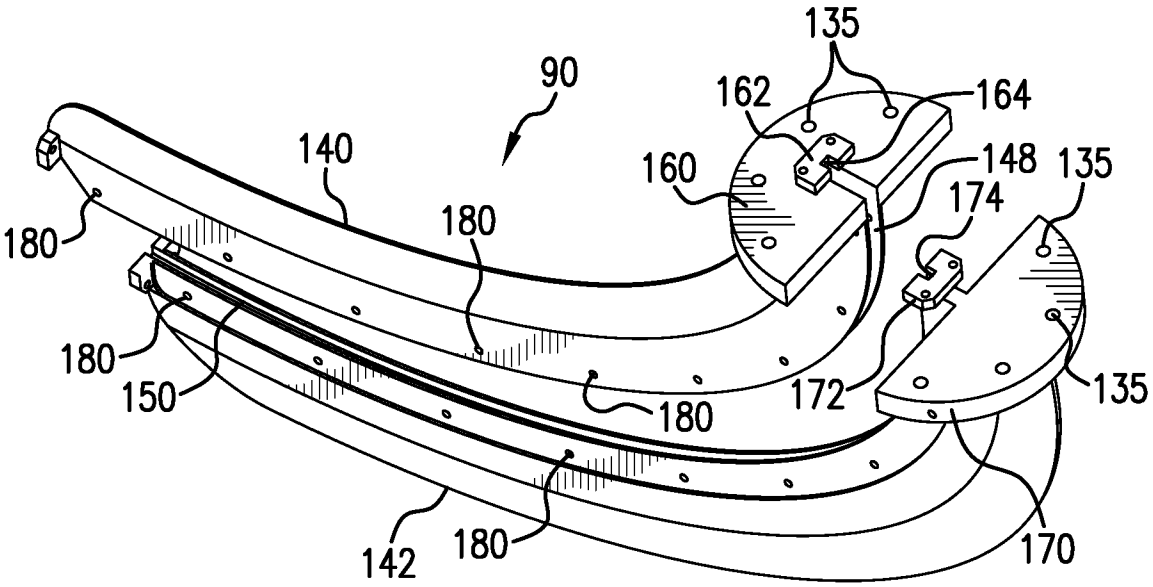
FIG. 6B is an exploded view, in perspective, of the strut assembly.
Figure 6A:
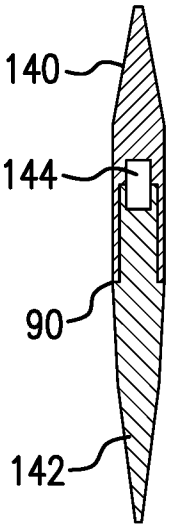
FIG. 6A is a cross-sectional view of a strut assembly shown in FIGS. 3 and 4.

Waveguide 144 has waveguide port 146 at distal second end 132. Section 140 defines channel 148 which extends for the entire length of section 140. Similarly, section 142 defines channel 150 which extends for the entire length of section 142. When sections 140 and 142 are attached or joined together, channels 148 and 150 combine to form waveguide 140. In this configuration, waveguide 140 is split across its broad walls where the electric currents are essentially zero, for minimum impact on waveguide performance. Section 140 includes portion 160 which has a generally semi-circular shape and includes thru-holes 135 for receiving bolts 136 (see FIG. 3) that fasten, attach or join strut 90 to reflector 12 as described in the foregoing description. Portion 160 includes a raised or stepped portion 162 that defines a channel 164 that is part of channel 148. Similarly, section 142 includes portion 170 that has a generally semi-circular shape and includes bolt holes 135 for receiving bolts 136 (not shown) that fasten, attach or join strut 90 to reflector 12. Portion 170 includes a raised or stepped portion 172 that defines a channel 174 that is part of channel 150. When sections 140 and 142 are joined together, stepped portions 162 and 172 contact each other such that channels 164 and 174 form a waveguide port. When joined together, stepped portions 162 and 172 fit within opening 27B in recess 27 such that the waveguide port is within opening 27B. A feed waveguide (not shown) is connected between the waveguide port in opening 27B and a communication system (not shown) on board the spacecraft. Flange 134 is also formed by portions 160 and 170 of sections 140 and 142, respectively. Referring to FIG. 6B, strut 16 includes through-holes 180 in each section 140 and 142 for receiving bolts 182 for attaching or joining sections 140 and 142 together. For a 26.5 GHz application, the cross-section of waveguide 130 is typically about 4 mm×8 mm and strut 16 has a thickness of about 8 mm. The cross-sectional length of strut 16 is arbitrarily chosen for mechanical strength purposes.

Figure 7:
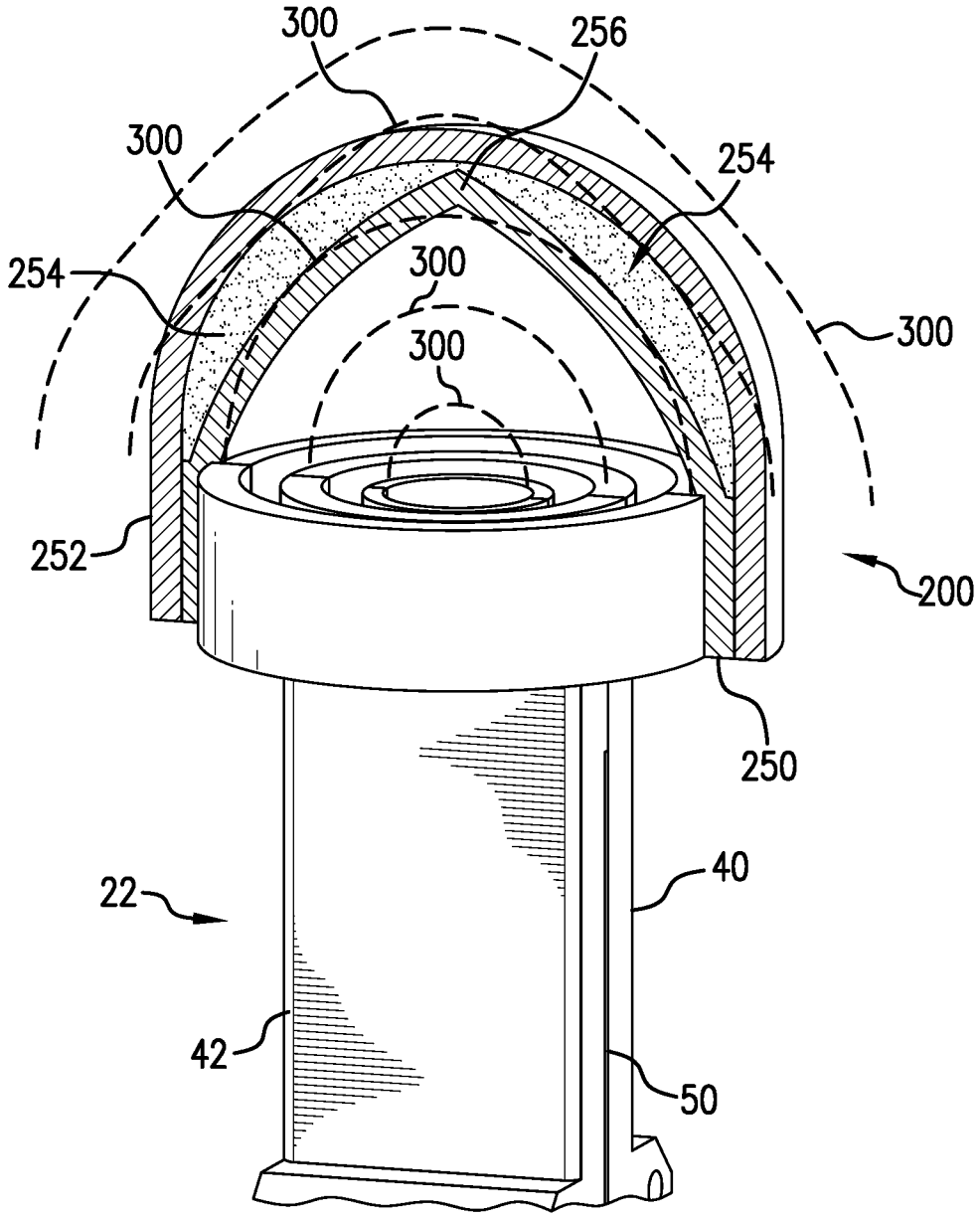
FIG. 7 is cross-sectional view of a lens assembly that is shown in FIGS. 3 and 4.

Referring to FIGS. 4 and 7, lens assembly 200 comprises inner matching layer 250, outer matching layer 252 and lens member 254 that is disposed between inner layer 250 and outer matching layer 252. In an exemplary embodiment, inner layer 250 is generally dome shaped and has apex 256. Inner layer 250 has an interior region that allows it to be fitted over the upper portion of feed horn 22. In an exemplary embodiment, lens member 254 is generally dome shaped. Lens member 254 has an interior region that is sized to receive and fit over inner member 250. In exemplary embodiment, outer matching layer 252 is generally dome shaped. Outer matching layer 252 has an interior region that is sized to fit over and receive lens member 254. In this embodiment, the central region of reflector surface 14 is the portion of reflector surface 14 that is the closest to lens assembly 200. Lens assembly 200 reduces microwave radiation towards the central region of reflector surface 14, thereby minimizing losses causes by back-reflection and scattering. In an exemplary embodiment, inner member 250 and outer matching member 252 are fabricated from Teflon, which has a dielectric constant of about 2.1 and a relatively low dielectric loss factor. However, other suitable materials having substantially the same dielectric constant and dielectric loss factor may be used as well. In an exemplary embodiment, lens member 254 is fabricated from Borosilicate glass which has a dielectric constant of about 4.4 and a very low dielectric loss factor. However, other suitable materials having substantially the same dielectric constant and dielectric loss factor may be used as well. It is to be understood that inner layer 250, outer matching layer 252 and lens member 254 may have suitable geometric shapes other than dome-shaped.

Matching layers 250 and 252 minimize reflections off the lens/free space boundary. This is achieved by using quarter-wavelength thick match layers 250 and 252 with a relative permittivity $\varepsilon_{layer}$ in relation with the lens permittivity $\varepsilon_{lens}$, satisfying $\varepsilon_{layer}=\sqrt{\varepsilon_{lens}}$. For example, if matching layers 250 and 252 are Teflon, then $\varepsilon_{layer}=2.1$ (i.e. a quarter-wavelength layer thickness is 2 mm at 26.5 GHz) while requiring $\varepsilon_{lens}=4.4$, which is satisfied by some glasses and fiber-glass substrate materials.

Figure 8:
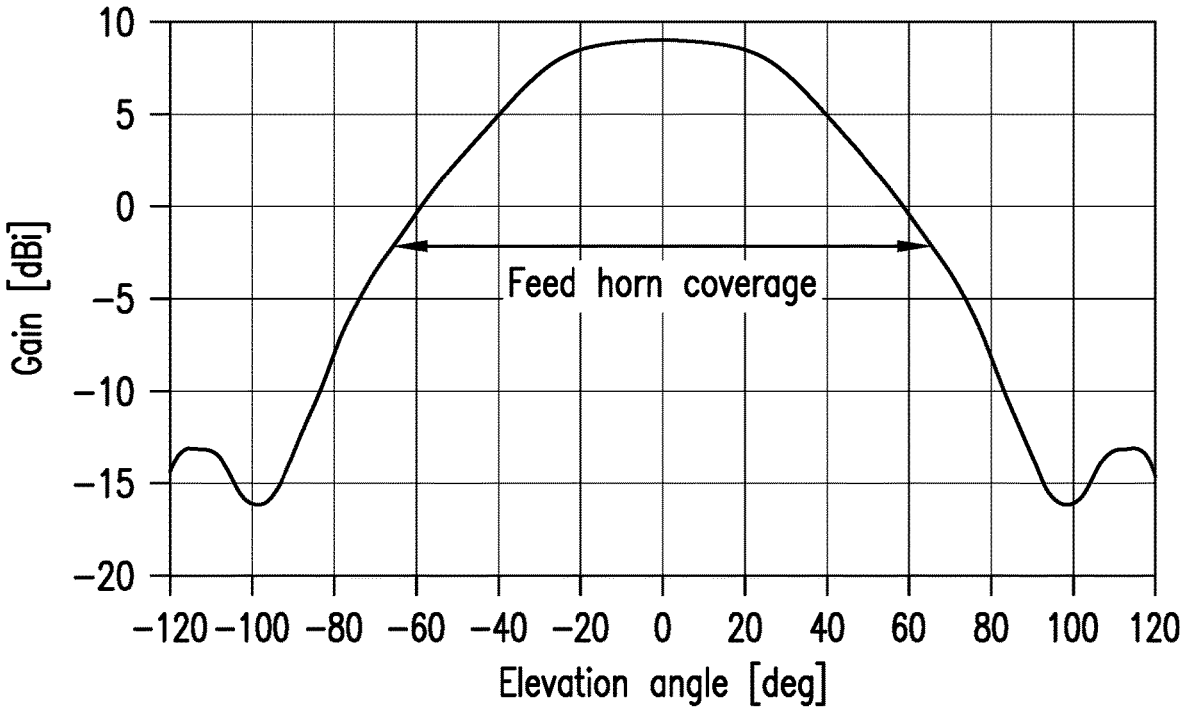
FIG. 8 illustrates the feed horn pattern without the lens assembly.
Figure 9:
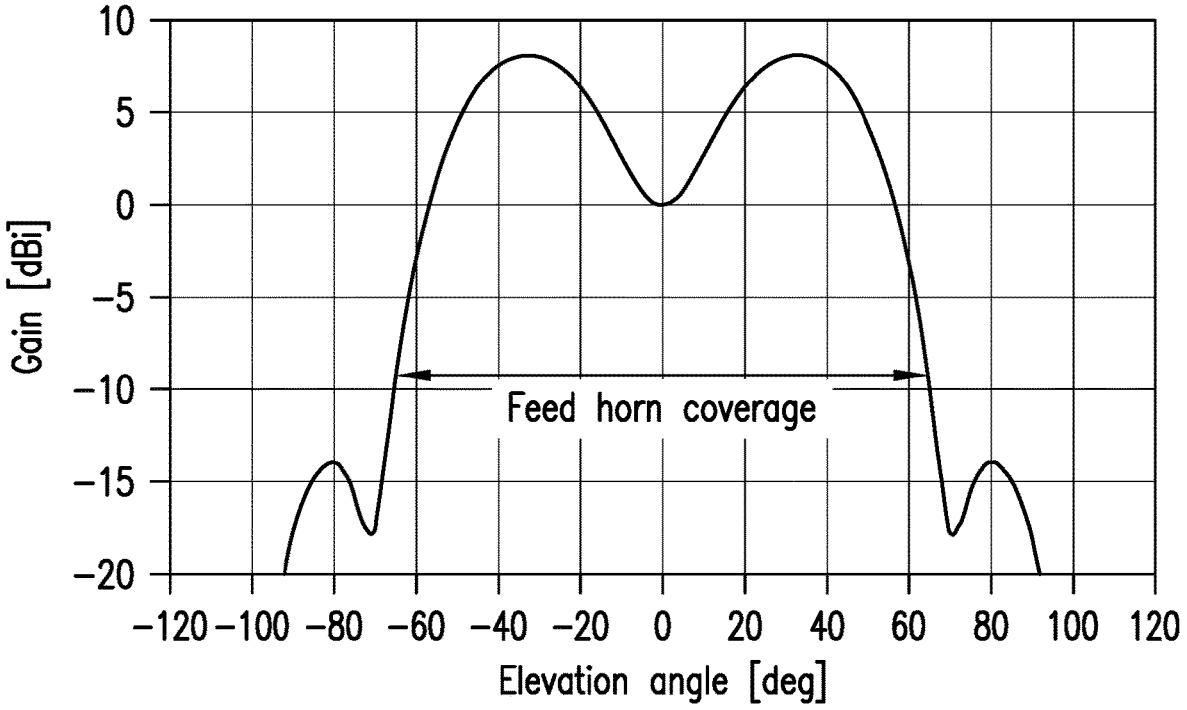
FIG. 9 illustrates the feed horn pattern with the lens assembly

Without lens assembly 200, the beam peak of feed horn 22 would be directed along its boresight towards the central part of reflector surface 14, and due to the relatively high intensity of the beam peak, a corresponding small portion of reflector surface 14 would be used to reflect radiation back towards nadir in order to preserve the correct field intensity on the ground. As a result, the feed blockage would have a relatively large impact on the radiation pattern towards nadir. Lens assembly 200 solves this problem by directing microwave radiation away from boresight as shown in FIG. 7. Lens assembly 200 flattens wave fronts 300 passing through it (as viewed in transmit mode) at an angle of about 45° from boresight thereby directing microwave energy in those directions while directing microwave energy away from boresight. FIG. 8 shows resultant feed horn pattern without lens assembly 200 and FIG. 9 shows the resultant feed horn pattern with lens assembly 200. As a result of using lens assembly 200 with feed horn 22, relatively less microwave radiation is now directed towards the central part of reflector surface 14 and relatively more microwave radiation is being reflected to nadir thereby reducing the relative impact of the feed blockage.

In conventional antenna systems, when the reflector reflects the feed horn radiation that is impinges upon the central region of the reflector, the reflected radiation is blocked by the feed horn itself. The reflected radiation impinging on the feed horn is either scattered away or absorbed by the feed horn and diverted by the polarizer into the load termination device. However, in antenna system 10 of the present invention, lens assembly 200 reduces these losses. These losses are even further minimized by microwave energy scattering device 200 which scatters most radiation away from feed horn 22.

The preceding description of the disclosed embodiments is provided to enable any person skilled in the art to make or use the present invention. The embodiments were chosen and described in order to best explain the principles of the invention and its practical applications. Various modifications to these embodiments will readily be apparent to those skilled in the art, and the generic principles defined herein may be applied to other embodiments without departing from the spirit or the scope of the invention. Thus, the present invention is not intended to be limited to the embodiments shown herein but is to be accorded the widest scope consistent with the following claims and the principles and novel features disclosed herein. Any reference to claim elements in the singular, for example, using the articles "a", "an" or "the" is not to be construed as limiting the element to the singular.

What is claimed is:

1. An antenna system comprising:

a reflector having a shaped reflector surface that has a central region; and a microwave energy scattering device attached to the reflector and located in the central region such that the microwave energy scattering device is centrally located on the reflector surface, the microwave energy scattering device being shaped to scatter impinging microwave energy emanating from a microwave energy source so as to reduce the amount of microwave energy that is reflected back to the microwave energy source.

2. The antenna system according to claim 1 wherein the reflector surface includes a generally flat peripheral region immediately surrounding the central region.

3. The antenna system according to claim 2 wherein the reflector includes a perimetrical edge and wherein the reflector surface slopes between the peripheral region and the perimetrical edge.

4. The antenna system according to claim 3 wherein the reflector includes a plurality of extending portions that are contiguous with the perimetrical edge, wherein a first one of the extending portions defines a thru-hole.

5. The antenna system according to claim 4 further comprising:

a strut having a generally arc shape, a first end attached to the first one of the extending portions of the reflector, a second distal end that is spaced apart from the microwave energy scattering device, the strut defining a strut internal waveguide therein that extends between the first end of the strut and the second distal end of the strut, the strut internal waveguide having a first waveguide port at the first end of the strut and a second waveguide port at the second waveguide port, the first waveguide port being aligned with the thru-hole in the first extending portion and adapted for connection to a feed waveguide that provides microwave radiation to the antenna system; and a feed horn connected to the distal second end of the strut for directing the microwave energy traveling through the strut internal waveguide to the reflector surface.

6. The antenna system according to claim 5 wherein the first extending portion of the reflector has a recessed area in which is located the thru-hole and wherein the first end of the strut has a flanged portion that is sized to fit into the recessed area of the first extending portion of the reflector.

7. The antenna system according to claim 5 wherein the feed horn has a feed horn internal waveguide having a pair of feed horn waveguide ports, wherein one of the feed horn waveguide ports receives microwave energy from the strut internal waveguide, the antenna system further including a load termination device that is connected to the other feed horn waveguide port.

8. The antenna system according to claim 7 wherein one of the feed horn waveguide ports produces right-hand circular polarization and the other feed horn waveguide port produces left-hand circular polarization.

9. The antenna system according to claim 7 wherein the feed horn includes a pair of feed horn sections that are connected together, each feed horn section defining a portion of the feed horn internal waveguide.

10. The antenna system according to claim 9 wherein the feed horn further comprises a polarizer fin disposed between the feed horn sections.

11. The antenna system according to claim 10 wherein one of the feed horn sections has a stepped recess sized for receiving the polarizer fin.

12. The antenna system according to claim 5 further including a lens assembly attached to the feed horn to reduce the amount of microwave energy that impinges on the microwave energy scattering device.

13. The antenna system according to claim 12 wherein the lens assembly further includes:

a shaped inner layer having an interior region sized to fit over a portion of a feed horn from which microwave energy emanates;

a shaped lens member having an interior region sized to receive the shaped inner layer; and a shaped outer layer having an interior region sized to receive the shaped lens member.

14. The antenna system according to claim 13 wherein the inner and outer layers are fabricated with a material that has a dielectric constant of about 2.1.

15. The antenna system according to claim 14 wherein the material is Teflon.

16. The antenna system according to claim 13 wherein the lens member is fabricated from a material that has a dielectric constant of about 4.4.

17. The antenna system according to claim 16 wherein the material is Borosilicate glass.

18. The antenna system according to claim 5 further including a pair of cables, each cable having one end attached to a corresponding one of the plurality of extending portions of the reflector and a second end attached to the strut in order to prevent sideways movement of the strut.

* * * * *